US006862957B2

(12) United States Patent
Wang

(10) Patent No.: US 6,862,957 B2
(45) Date of Patent: Mar. 8, 2005

(54) COMBINATION TOOL FOR ASSEMBLING AND DISMANTLING A LOCK NUT OF A BEARING OF WHEEL AXLE OF A WHEELED VEHICLE

(76) Inventor: Yu-Yen Wu Wang, P.O. Box 55-124, Taichung (TW)

( * ) Notice: Subject to any disclaimer, the term of this patent is extended or adjusted under 35 U.S.C. 154(b) by 46 days.

(21) Appl. No.: 10/352,966

(22) Filed: Jan. 29, 2003

(65) Prior Publication Data

US 2004/0144213 A1 Jul. 29, 2004

(51) Int. Cl.[7] ..... B25B 13/28
(52) U.S. Cl. ..... 81/91.3; 81/176.3
(58) Field of Search ..... 81/91.3, 91.1, 81/126, 128, 125, 129, 176.15, 176.2, 176.3, 6; 269/2

(56) References Cited

U.S. PATENT DOCUMENTS

| | | | | | |
|---|---|---|---|---|---|
| 2,052,458 | A | * | 8/1936 | Froelich | 81/3.42 |
| 2,403,264 | A | * | 7/1946 | Cormier | 81/6 |
| 2,476,608 | A | * | 7/1949 | Kinsey | 81/91.3 |
| 3,119,290 | A | * | 1/1964 | Ivie | 81/128 |
| 3,910,140 | A | * | 10/1975 | Rose | 81/176.3 |

* cited by examiner

*Primary Examiner*—David B. Thomas

(57) ABSTRACT

A combination tool for assembling and dismantling a lock nut includes a middle column, two clamping blocks, a guide rod, and two links. Thus, the two clamping blocks, the two links and the middle column are interconnected with each other and are moved in concert with each other, so that the distance between the two clamping blocks can be adjusted rapidly and arbitrarily, thereby facilitating the user operating the combination tool.

10 Claims, 7 Drawing Sheets

COMBINATION TOOL FOR ASSEMBLING AND DISMANTLING A LOCK NUT OF A BEARING OF WHEEL AXLE OF A WHEELED VEHICLE

BACKGROUND OF THE INVENTION

1. Field of the Invention

The present invention relates to a combination tool for assembling and dismantling a lock nut of a bearing of a wheel axle of a wheeled vehicle such as an automobile or the like, wherein the two clamping blocks, the two links and the middle column are interconnected with each other and are moved in concert with each other, so that the distance between the two clamping blocks can be adjusted rapidly so as to lock the lock nut rapidly, thereby facilitating the user operating the combination tool.

2. Description of the Related Art

Usually, the distal end of the wheel axle of an automobile is provided with a bearing, and a lock nut is screwed on the outside of the bearing for positioning the bearing. Thus, it is necessary to remove the lock nut for replacing the bearing when the bearing is worn out. The lock nut includes a hexagonal nut or an octagonal nut. In general, the operator has to use a hexagonal socket wrench for assembling and dismantling the hexagonal lock nut, and to use an octagonal socket wrench for assembling and dismantling the octagonal lock nut.

A conventional combination tool for assembling and dismantling a lock nut of a bearing of a wheel axle of a wheeled vehicle in accordance with the prior art shown in FIGS. 1 and 2 includes a middle column 1, a first clamp block 2, a second clamp block 3, a regulating threaded rod 4, and a support rod 5.

The middle column 1 has a first end formed with a square recess 104.

The first clamp block 2 and the second clamp block 3 are located at the two sides of the middle column 1 respectively, and the distance between the first clamp block 2 and the middle column 1 is equal to that between the second clamp block 3 and the middle column 1. Namely, the middle column 1 is located at the middle position between the first clamp block 2 and the second clamp block 3. The first clamp block 2 has one end provided with a clamp pawl 206, and the second clamp block 3 has one end respectively provided with a clamp pawl 306. Each of the first clamp block 2 and the second clamp block 3 has a distal end having a central portion respectively screwed with a pin 204 and 304 that may be inserted into two opposite holes of a disk-shaped lock nut (not shown), for assembling and dismantling the disk-shaped lock nut.

The regulating threaded rod 4 is extended through the middle column 1, so that the middle column 1 is positioned at the middle section of the regulating threaded rod 4. The middle section of the regulating threaded rod 4 is formed with an annular insertion groove 402. A positioning bolt 102 is radially extended through the second end of the middle column 1 and has a distal end inserted into the insertion groove 402 of the regulating threaded rod 4, such that the middle column 1 is positioned at the middle section of the regulating threaded rod 4. The regulating threaded rod 4 has a first end provided with a first threaded section 404 and a second end provided with a second threaded section 406 that has a screw direction opposite to that of the first threaded section 404. The first threaded section 404 and the second threaded section 406 are extended through the first clamp block 2 and the second clamp block 3 respectively. Thus, when the regulating threaded rod 4 is rotated, the first clamp block 2 and the second clamp block 3 are driven to move toward each other or to move outward relative to each other on the regulating threaded rod 4, such that the distance between the first clamp block 2 and the second clamp block 3 can be adjusted.

The support rod 5 is in turn extended through the second clamp block 3, the middle column 1, and is pivotally inserted into the first clamp block 2, to support and position the middle column 1, the first clamp block 2, and the second clamp block 3.

In operation, when the regulating threaded rod 4 is rotated, the middle column 1, the first clamp block 2, and the second clamp block 3 are retained by the support rod 5, so that they are not rotated with the regulating threaded rod 4, thereby capable of changing the distance between the first clamp block 2 and the second clamp block 3. At this time, the support rod 5 may be rotated properly, so that the distal end of the support rod 5 is retained by the first clamp block 2 without restricting displacement of the first clamp block 2 and the second clamp block 3. The distal end of the positioning bolt 102 is inserted into the insertion groove 402 of the regulating threaded rod 4, such that the middle column 1 is positioned at the middle section of the regulating threaded rod 4.

In practice, when the conventional combination tool is used in a hexagonal lock nut, the pins 204 and 304 are removed, and the inner edges of the clamp pawls 206 and 306 can urge and clamp the outer periphery of the hexagonal lock nut. Thus, the driver head of the ratchet wrench can be inserted into the recess 104 to rotate the middle column 1, so as to drive the first clamp block 2 and the second clamp block 3 to rotate, so that the hexagonal lock nut can be rotated, so as to assemble and dismantle the hexagonal lock nut.

Alternatively, when the conventional combination tool is used in a disk-shaped lock nut, the pins 204 and 304 are respectively screwed on the first clamp block 2 and the second clamp block 3, while the distal ends of the pins 204 and 304 are respectively inserted into the two holes of the disk-shaped lock nut. Thus, the driver head of the ratchet wrench can be inserted into the recess 104 of the middle column 1 to rotate the middle column 1, so as to drive the first clamp block 2 and the second clamp block 3 to rotate, so that the disk-shaped lock nut can be rotated, so as to assemble and dismantle the disk-shaped lock nut.

Accordingly, the conventional combination tool can be used to assemble and dismantle the lock nuts of different kinds and sizes, without having to prepare tools of different specifications and types, thereby facilitating the operator assembling and dismantling the lock nuts.

SUMMARY OF THE INVENTION

The primary objective of the present invention is to provide a combination tool for assembling and dismantling a lock nut of a bearing of a wheel axle of a wheeled vehicle, wherein the two clamping blocks, the two links and the middle column are interconnected with each other and are moved in concert with each other, so that the distance between the two clamping blocks can be adjusted rapidly and arbitrarily, thereby facilitating the user operating the combination tool.

Another objective of the present invention is to provide a combination tool for assembling and dismantling a lock nut of a bearing of a wheel axle of a wheeled vehicle, wherein when the clamping jaws of the two clamping blocks are clamped on the periphery of a lock nut, the ratchet teeth can enhance the relative stress between the clamping jaws and the hexagonal lock nut, thereby closely clamping the hexagonal lock nut rigidly and stably.

A further objective of the present invention is to provide a combination tool for assembling and dismantling a lock nut of a bearing of a wheel axle of a wheeled vehicle, wherein the combination tool can be used to assemble and dismantle lock nuts of different kinds and sizes, without having to prepare tools of different specifications and types, thereby facilitating the operator assembling and dismantling the lock nuts.

In accordance with the present invention, there is provided a combination tool for assembling and dismantling a lock nut, comprising a middle column, two clamping blocks, a guide rod, and two links, wherein:

the two clamping blocks are respectively located at the two sides of the middle column symmetrically;

the guide rod is in turn extended through the two clamping blocks to guide the two clamping blocks to axially slide and displace on the guide rod reciprocally; and each of the two links is pivotally mounted between the middle column and a respective one of the two clamping blocks, so that the two clamping blocks, the two links and the middle column are interconnected with each other and are moved in concert with each other.

Further benefits and advantages of the present invention will become apparent after a careful reading of the detailed description with appropriate reference to the accompanying drawings.

DETAILED DESCRIPTION OF THE INVENTION

Figure 1:
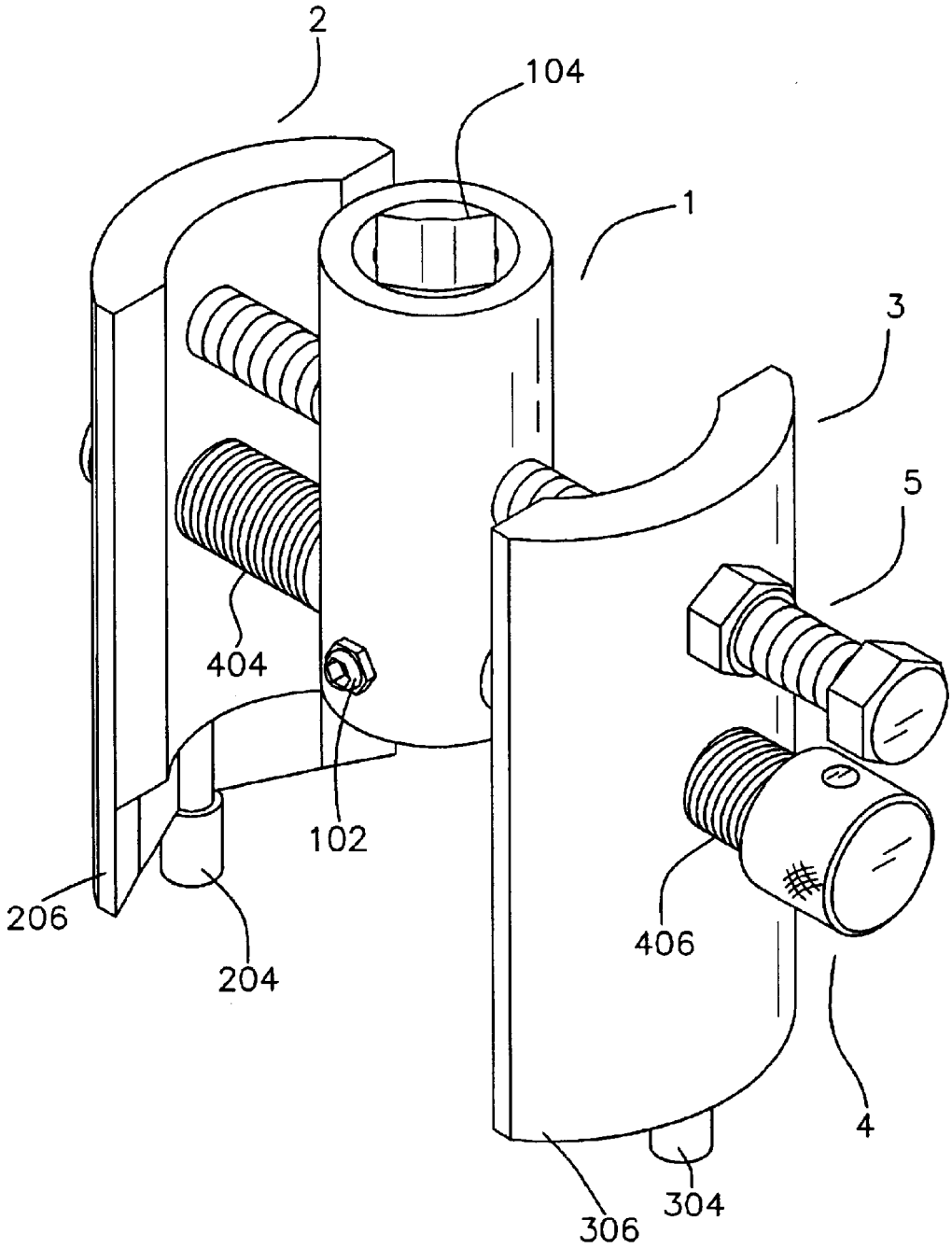
FIG. 1 PRIOR ART
FIG. 1 is a perspective view of a conventional combination tool for assembling and dismantling a lock nut of a bearing of a wheel axle of a wheeled vehicle in accordance with the prior art.
Figure 2:
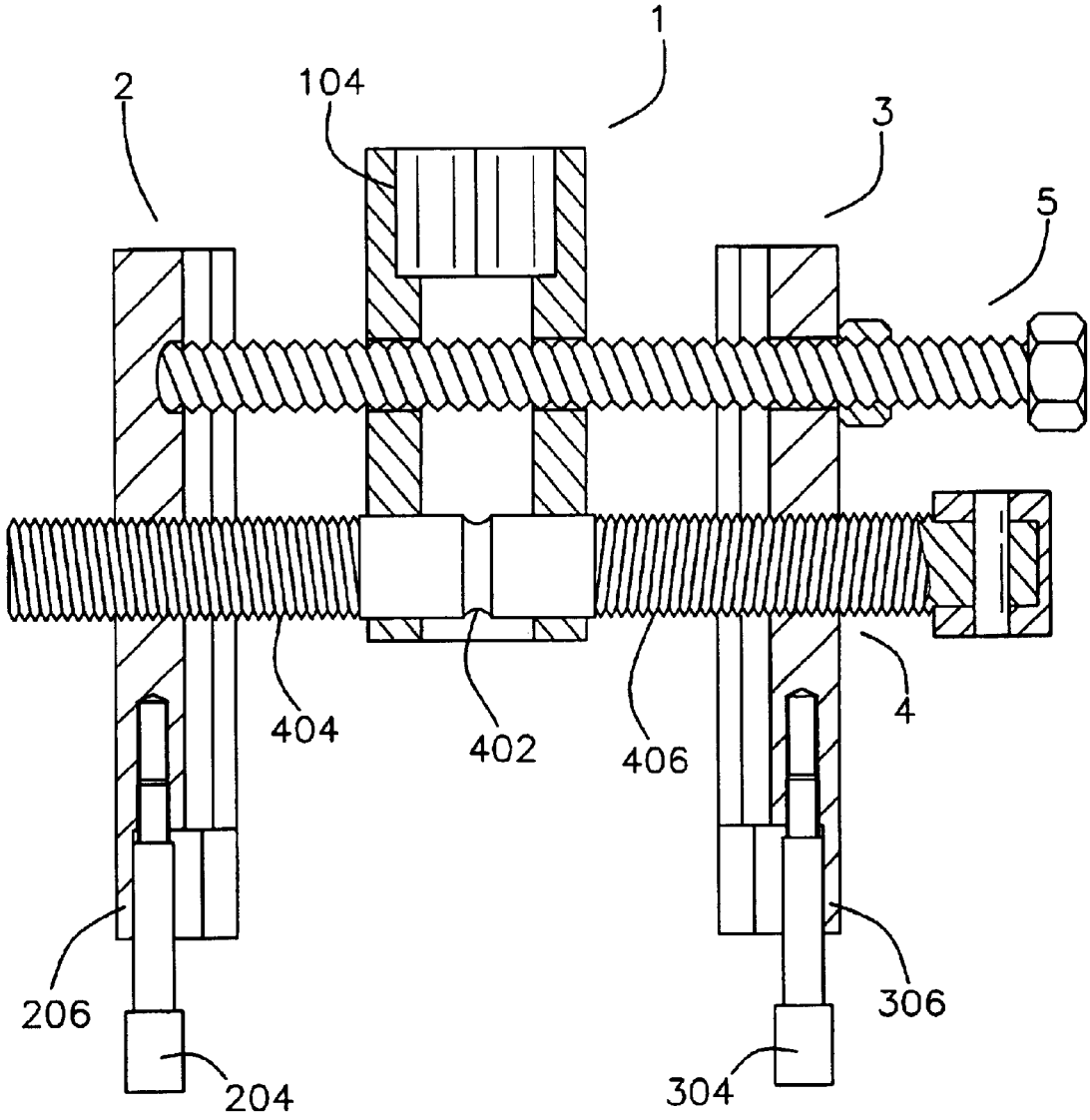
FIG. 2 PRIOR ART
FIG. 2 is a front plan cross-sectional view of the conventional combination tool for assembling and dismantling a lock nut of a bearing of a wheel axle of a wheeled vehicle as shown in FIG. 1.
Figure 3:
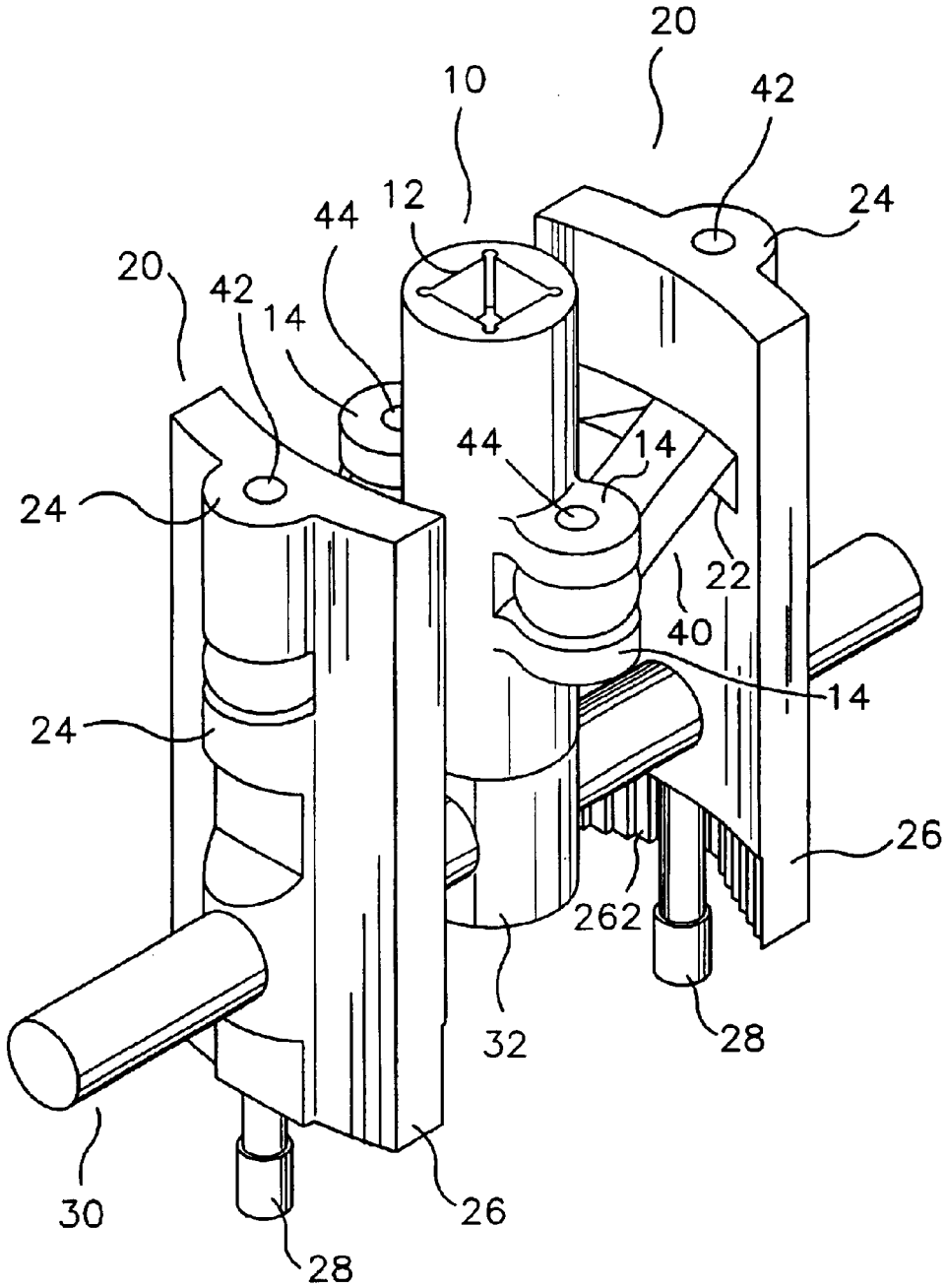
FIG. 3 is a perspective view of a combination tool for assembling and dismantling a lock nut of a bearing of a wheel axle of a wheeled vehicle in accordance with the preferred embodiment of the present invention.
Figure 4:
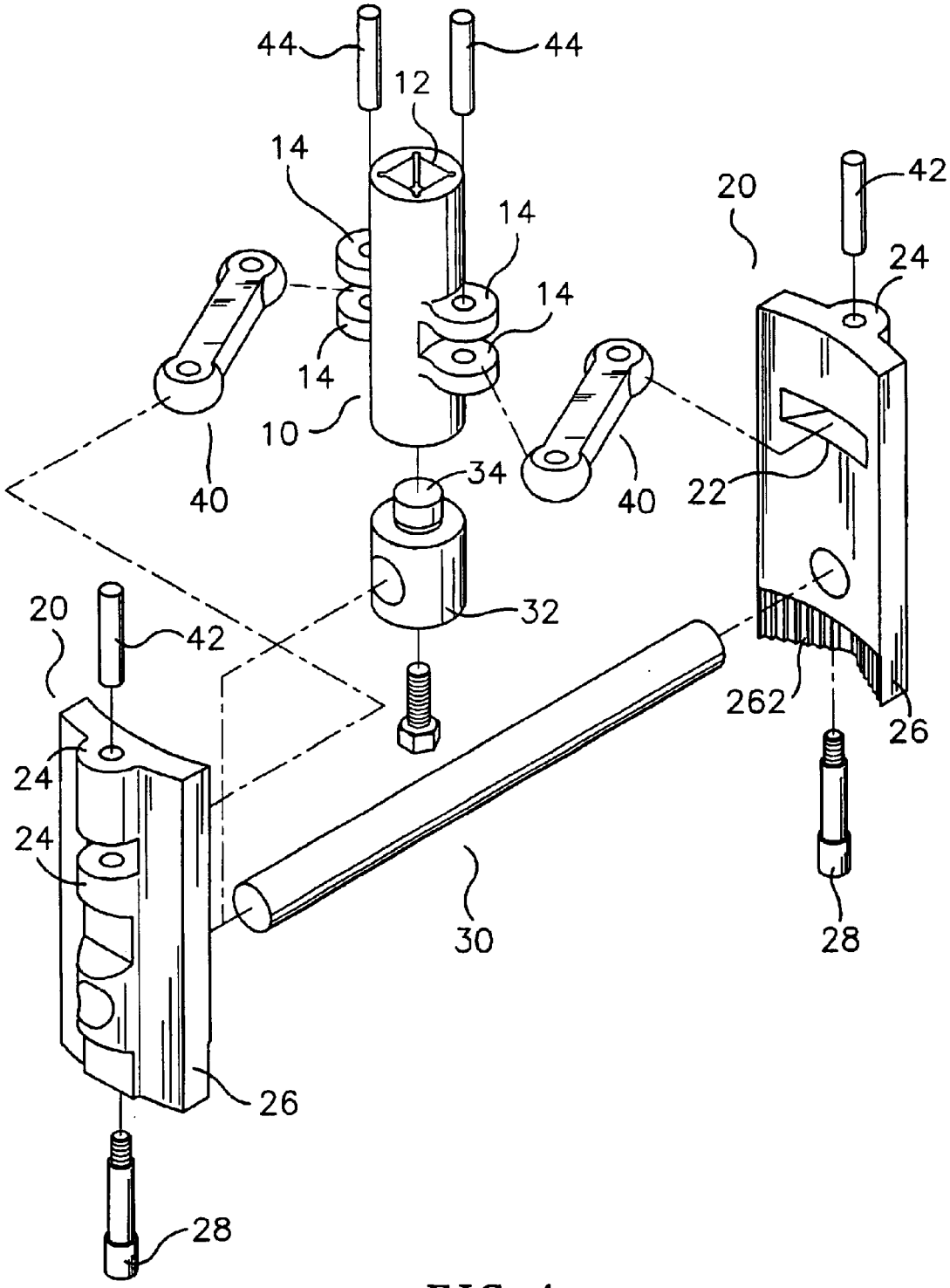
FIG. 4 is an exploded perspective view of the combination tool for assembling and dismantling a lock nut of a bearing of a wheel axle of a wheeled vehicle in accordance with the preferred embodiment of the present invention.
Figure 5:
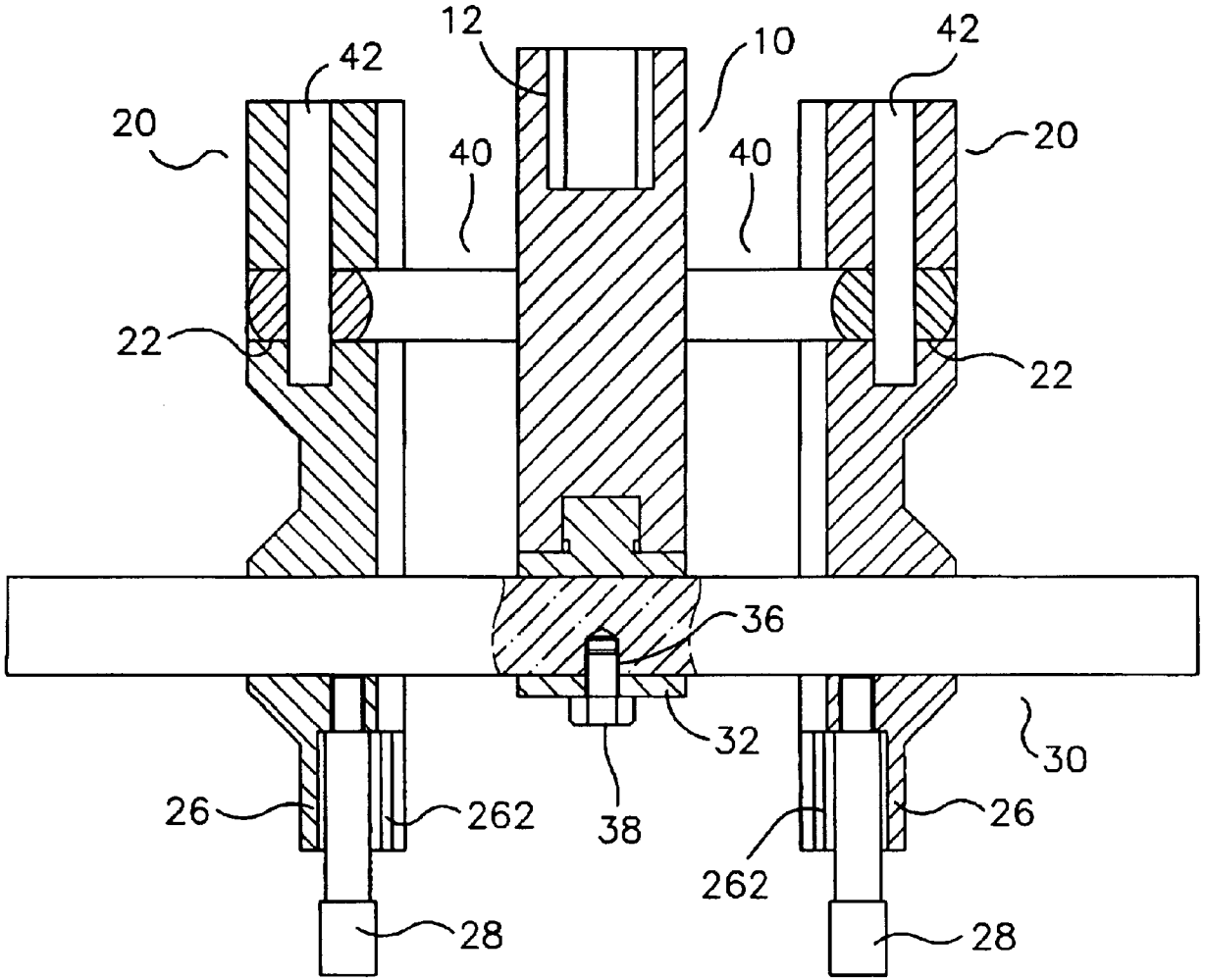
FIG. 5 is a front plan cross-sectional view of the combination tool for assembling and dismantling a lock nut of a bearing of a wheel axle of a wheeled vehicle as shown in FIG. 3.

Referring to the drawings and initially to FIGS. 3–5, a combination tool for assembling and dismantling a lock nut of a bearing of a wheel axle of a wheeled vehicle in accordance with the preferred embodiment of the present invention comprises a middle column 10, two clamping blocks 20, a guide rod 30, and two links 40.

The middle column 10 has a first end formed with a square recess 12. The middle column 10 has a periphery formed with two pairs of radially opposite spaced pivot ears 14.

The two clamping blocks 20 are respectively located at the two sides of the middle column 1 symmetrically. Each of the two clamping blocks 20 has a first side formed with a pivot slot 22 and a second side formed with two spaced pivot tubes 24 each communicating with the pivot slot 22. Each of the two clamping blocks 20 has one end formed with a clamping jaw 26 formed with a plurality of ratchet teeth 262. Each of the two clamping blocks 20 has a distal end having a central portion screwed with a pin 28 that can be inserted into one of two opposite holes of a disk-shaped lock nut (not shown), for assembling and dismantling the disk-shaped lock nut.

The guide rod 30 is in turn extended through the two clamping blocks 20, to guide the two clamping blocks 20 to axially slide and displace on the guide rod 30 reciprocally. A holding seat 32 is secured on a mediate portion of the guide rod 30, and has a top pivotally mounted on a second end of the middle column 1. Preferably, the top of the holding seat 32 is formed with a circular pivot shaft 34 pivotally mounted on the second end of the middle column 1. Preferably, the mediate portion of the guide rod 30 is radially formed with a passage hole 36. A positioning bolt 38 is extended through the passage hole 36 of the guide rod 30, and is screwed into a bottom of the holding seat 32, so that the holding seat 32 is secured on the mediate portion of the guide rod 30 by the positioning bolt 38.

The ratchet teeth 262 of each of the two clamping blocks 20 have a first side in parallel with an axial axis of the guide rod 30 and a second side vertical to the axial axis of the guide rod 30. Thus, when the clamping jaws 26 of the two clamping blocks 20 are clamped on the periphery of a hexagonal lock nut (not shown), the ratchet teeth 262 can enhance the relative stress between the clamping jaws 26 and the hexagonal lock nut, thereby closely clamping the hexagonal lock nut rigidly and stably.

Each of the two links 40 is pivotally mounted between the middle column 10 and a respective one of the two clamping blocks 20. Each of the two links 40 has a first end pivotally mounted in the pivot slot 22 of the respective clamping block 20 and a second end pivotally mounted between the two spaced pivot ears 14 of the middle column 10.

The combination tool further comprises two first pivot shafts 42 each extended through the two spaced pivot tubes 24 of a respective one of the two clamping blocks 20 and through the first end of a respective one of the two links 40, so that the first end of each of the two links 40 is pivotally mounted on the respective clamping block 20.

The combination tool further comprises two second pivot shafts 44 each extended through the two spaced pivot ears 14 of the middle column 10 and through the second end of a respective one of the two links 40, so that the second end of each of the two links 40 is pivotally mounted on the middle column 10.

Figure 6:
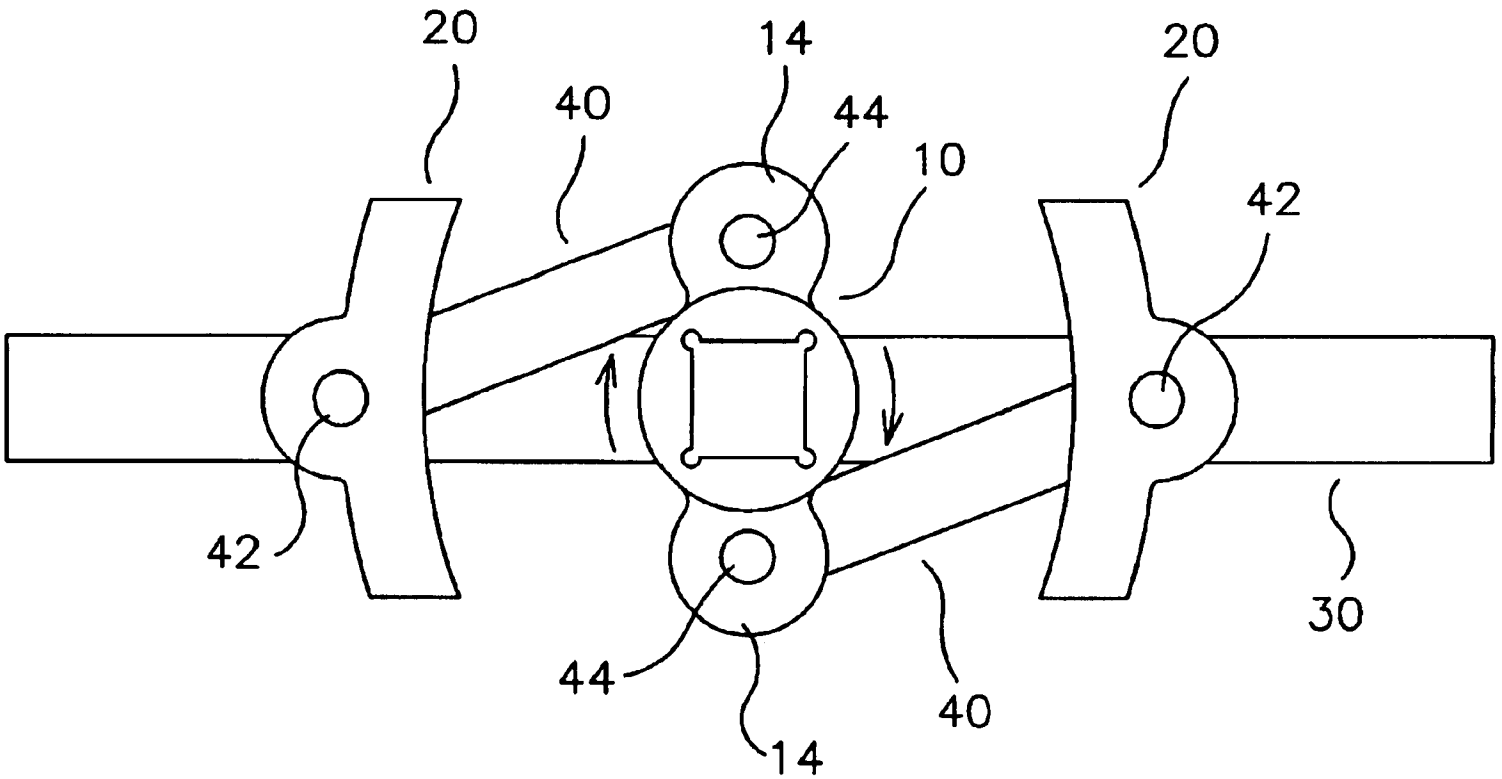
FIG. 6 is a schematic top plan operational view of the combination tool for assembling and dismantling a lock nut of a bearing of a wheel axle of a wheeled vehicle as shown in FIG. 3.

In operation, referring to FIG. 6 with reference to FIGS. 3–5, the two clamping blocks 20 are pulled outward to axially slide and displace on the guide rod 30, thereby increasing the distance between the two clamping blocks 20. In such a manner, the two clamping blocks 20, the two links 40 and the middle column 10 are interconnected, so that during displacement of the two clamping blocks 20, each of the two links 40 is pivoted about the respective first pivot shaft 42, to drive the middle column 10 to rotate. At this time, the distance between the middle column 10 and each of the two clamping blocks 20 is equal.

In practice, when the combination tool is used in the hexagonal lock nut, the pins 28 are removed, and the clamping jaws 26 of the clamping blocks 20 are clamped on the periphery of the hexagonal lock nut. Thus, the driver head of a ratchet wrench (not shown) can be inserted into the square recess 12 to rotate the middle column 10. In such a manner, the two clamping blocks 20, the two links 40 and the middle column 10 are interconnected, so that when the middle column 10 is rotated clockwise, each of the two links 40 is moved by the middle column 10 to drive each of the two clamping blocks 20 to move toward the middle column 10, so that the clamping jaws 26 of the clamping blocks 20 are closely clamped on the periphery of the hexagonal lock nut rigidly and stably so as to lock the hexagonal lock nut. When the middle column 10 is rotated counterclockwise, the hexagonal lock nut is detached from the clamping jaws 26 of the clamping blocks 20.

Alternatively, when the combination tool is used in the disk-shaped lock nut, the pins 28 are screwed on the clamping blocks 20, while the distal ends of the pins 28 are inserted into the two opposite holes of the disk-shaped lock nut. Thus, the driver head of a ratchet wrench (not shown) can be inserted into the square recess 12 to rotate the middle column 10. In such a manner, the two clamping blocks 20, the two links 40 and the middle column 10 are interconnected, so that when the middle column 10 is rotated clockwise, each of the two links 40 is moved by the middle column 10 to drive each of the two clamping blocks 20 to move toward the middle column 10, so that the pins 28 are closely combined with the disk-shaped lock nut rigidly and stably so as to lock the hexagonal lock nut. When the middle column 10 is rotated counterclockwise, the disk-shaped lock nut is detached from the pins 28 of the clamping blocks 20.

Figure 7:
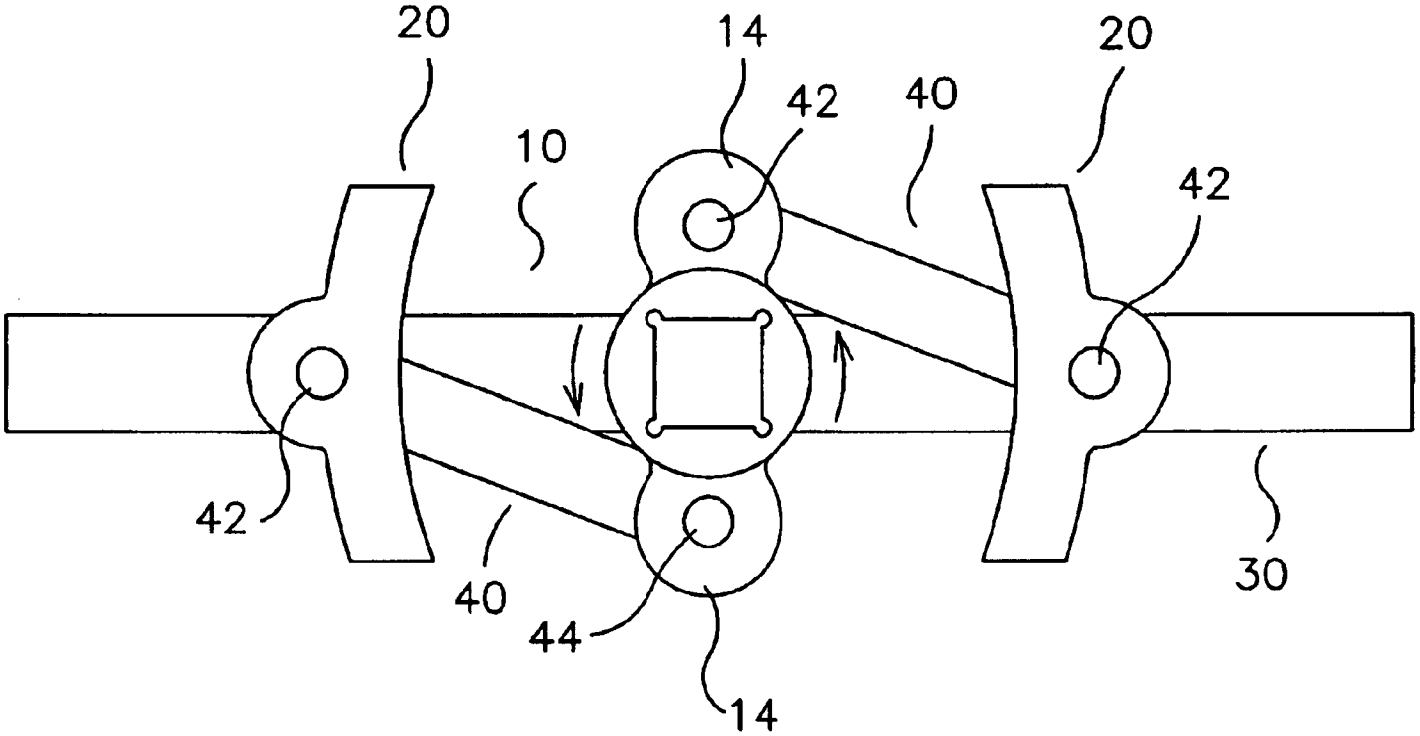
FIG. 7 is another schematic top plan operational view of the combination tool for assembling and dismantling a lock nut of a bearing of a wheel axle of a wheeled vehicle as shown in FIG. 3.

On the other hand, referring to FIG. 7 with reference to FIGS. 3–5, the two clamping blocks 20 are pulled outward and the middle column 10 is rotated, so that each of the two links 40 is moved from the position as shown in FIG. 6 to the position as shown in FIG. 7. In such a manner, when the middle column 10 is rotated counterclockwise, each of the two links 40 is moved by the middle column 10 to drive each of the two clamping blocks 20 to move toward the middle column 10, so that the clamping jaws 26 of the clamping blocks 20 are closely clamped on the periphery of the hexagonal lock nut rigidly and stably so as to unlock the hexagonal lock nut. When the middle column 10 is rotated clockwise, the hexagonal lock nut is detached from the clamping jaws 26 of the clamping blocks 20.

Accordingly, the two clamping blocks 20, the two links 40 and the middle column 10 are interconnected with each other and are moved in concert with each other, so that the distance between the two clamping blocks 20 can be adjusted rapidly and arbitrarily, thereby facilitating the user operating the combination tool.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination tool for assembling and dismantling a lock nut, comprising a middle column, two clamping blocks, a guide rod, and two links, wherein:

the two clamping blocks are respectively located at the two sides of the middle column symmetrically;

the guide rod is in turn extended through the two clamping blocks to guide the two clamping blocks to axially slide and displace on the guide rod reciprocally; and each of the two links is pivotally mounted between the middle column and a respective one of the two clamping blocks, so that the two clamping blocks, the two links and the middle column are interconnected with each other and are moved in concert with each other.

2. The combination tool in accordance with claim 1, wherein the middle column has a first end formed with a square recess.

3. The combination tool in accordance with claim 1, wherein the middle column has a periphery formed with two pairs of radially opposite spaced pivot ears, and each of the two links has a second end pivotally mounted between the two spaced pivot ears of the middle column.

4. The combination tool in accordance with claim 3, further comprising two second pivot shafts each extended through the two spaced pivot ears of the middle column and through the second end of a respective one of the two links, so that the second end of each of the two links is pivotally mounted on the middle column.

5. The combination tool in accordance with claim 1, wherein each of the two clamping blocks has one end formed with a clamping jaw formed with a plurality of ratchet teeth.

6. The combination tool in accordance with claim 5, wherein the ratchet teeth of each of the two clamping blocks have a first side in parallel with an axial axis of the guide rod and a second side vertical to the axial axis of the guide rod.

7. The combination tool in accordance with claim 1, wherein each of the two clamping blocks has a distal end having a central portion screwed with a pin.

8. The combination tool in accordance with claim 1, further comprising a holding seat secured on a mediate portion of the guide rod and having a top pivotally mounted on a second end of the middle column.

9. The combination tool in accordance with claim 8, wherein the top of the holding seat is formed with a pivot shaft pivotally mounted on the second end of the middle column.

10. The combination tool in accordance with claim 8, wherein the mediate portion of the guide rod is radially formed with a passage hole, and the combination tool further comprises a positioning bolt extended through the passage hole of the guide rod and screwed into a bottom of the holding seat, so that the holding seat is secured on the mediate portion of the guide rod by the positioning bolt.

* * * * *